United States Patent [19]

Nordholm et al.

[11] Patent Number: 4,884,067

[45] Date of Patent: Nov. 28, 1989

[54] MOTION AND POSITION SENSING ALARM

[75] Inventors: Ken Nordholm; Bud Eyers, both of Vancouver, Canada

[73] Assignee: Talkie Tooter (Canada) Ltd., Vancouver, Canada

[21] Appl. No.: 84,959

[22] Filed: Aug. 13, 1987

[51] Int. Cl.[4] ..... G08B 19/00

[52] U.S. Cl. ..... 340/686; 200/61.52; 340/522; 340/529; 340/573; 340/689

[58] Field of Search ..... 340/593, 594, 614, 615, 340/566, 571, 572, 568, 506, 573/529, 689, 686, 530, 522; 200/61.45 R, 61.52

[56] References Cited

U.S. PATENT DOCUMENTS

| | | | |
|---|---|---|---|
| 3,733,447 | 5/1973 | Schneider, Jr. | 200/61.45 R |
| 3,752,945 | 8/1973 | Achterberg | 200/61.52 |
| 4,196,429 | 4/1980 | Davis | 340/573 |
| 4,234,876 | 11/1980 | Murai | 340/566 |
| 4,264,899 | 4/1981 | Menzies et al. | 200/61.52 |
| 4,337,462 | 6/1982 | Lemelson | 340/539 |
| 4,356,423 | 10/1982 | Gudzin | 340/566 |
| 4,418,337 | 11/1983 | Bader | 340/573 |
| 4,450,326 | 5/1984 | Ledger | 340/566 |
| 4,455,551 | 6/1984 | Lemelson | 340/539 |
| 4,511,886 | 4/1985 | Rodriguez | 340/506 |
| 4,524,349 | 6/1985 | Hyatt | 340/506 |
| 4,527,153 | 7/1985 | Suzuki et al. | 340/572 |
| 4,577,182 | 3/1986 | Millsap et al. | 340/539 |
| 4,581,506 | 4/1986 | Bai et al. | 200/61.45 R |

*Primary Examiner*—Glen R. Swann, III

*Attorney, Agent, or Firm*—Christensen, O'Connor, Johnson & Kindness

[57] ABSTRACT

A personal security communication system is disclosed. It is comprised of a motion and position sensor adapted to detect motion and lack of motion. The sensor has a motion and position sensing switch having means indicative of the motion of a contact making element in the switch and is adapted to provide at least a first and second electrical state according to the motion and lack of motion of the contact making element. Means is provided for detecting the first and second electrical state. The detecting means being adapted to provide a signal indicative of the electrical state of said switch. The system also includes user input means, processor means for receiving information from said motion sensing means and said user input means and adapted to format a digital data message indicative of said information, a transmitter means for transmitting said message, an alarm means activatable by said processor means and a power supply means for powering said processor means, transmitter and alarm means.

43 Claims, 10 Drawing Sheets

MOTION AND POSITION SENSING ALARM

FIELD OF THE INVENTION

This invention relates to personal security communication systems and more particularly to motion sensing alarms and motion and position sensors.

DESCRIPTION OF THE PRIOR ART

A number of occupations wherein workers are isolated and working in dangerous emvironments require that the workers by continuously monitored. For example, a security guard making his rounds on the premises of a building may be required to inform a central office of his whereabouts.

Within the forest industry, the forest workers face greater dangers. a buddy system of monitoring a worker's status is used extensively. The present buddy system usually requires a worker to occasionally stop working and physically monitor the work of his buddy. The major shortcoming of this method is that an emergency situation is only detected when the buddy stops work to monitor the situation, and accordingly, productivity is affected by requiring the workers to pause periodically.

In another situation, the workers are in a group with one member whose sole responsability is to detect if any member of the group is in need of assistance. This is usually accomplished by having this member move from one worker to the next and verifying that all is well within the group. In these situations, the group productivity is limited because one member of the group is not able to work continuously.

In another area, it was found that Customs and Immigration inspectors are from time to time placed at risk while in performance of their duties. In particular, there have been a number of incidents of unprovoked attack or the threat of attack by persons passing through Customs Offices or entry points at a border. There have also been instances of Customs inspectors whose duties placed them in remote and/or isolated locations requiring emergency assistance as a result of accident or other acute personal disability.

A security transmitting device and its associated alarm was tested and found unsuitable. Activation of the device could be achieved manually and would be achieved automatically under conditions intended to reflect the wearer down and incapacitated. The device provided sensing of attitude, specifically that when the longitudinal dimension of the device as worn on the hip of the user was within 30° of the horizontal. A mercury switch would close and thereby provide the first condition for alarm transmission. Secondly, if the mercury switch remained closed for more than a preset time, for example 30 seconds, the second condition would be met and an alarm transmitted without further involvement by the wearer and without visible or audible indication to either the wearer or a pressumed assailant.

Field trials of the device demonstrated an unacceptably high false alarm rate primarily caused by an activation of the man-down switch under normal working conditions. One of the problems associated with the use of this device is that the sensor does not impose a motion detecting condition on the initiation of the alarms. Accordingly, it was concluded that the parameters of position (attitude) and time were not sufficient to accommodate the working conditions of Customs inspectors.

Accordingly, there is a requirement for a motion and position sensor adapted to be indicative of motion or lack of motion when the sensor is in a particular orientation.

There is also a requirement for a sensor adapted to utilize the sensing parameters of motion, time and angle from the horizontal.

In addition, there is a requirement for a personal security communication system capable of automatically detecting a specified status and transmitting this information over a digital radio link to others working nearby or to a central station.

SUMMARY OF THE INVENTION

It is therefore an object of the present invention to provide an improved motion and position sensing switch adapted to be indicative of motion of a contact making element as well as the orientation of the switch.

Another object of the present invention is to provide an improved motion and position sensor adapted to detect motion and lack of motion over time of a contact making element when the sensor is pivoted to a predetermined attitude.

Yet another object of the present invention is to provide a personal security communication system in which workers wear small portable units capable of automatically detecting their status and transmitting the information over a digital radio link to other workers nearby or to a central station.

Accordingly, a first aspect of the present invention is to provide a motion and position sensing switch comprising:

an enclosure having a cavity;

a contact making element resting in said cavity, said cavity being capped with a plate having a conductive circuit thereon, said cavity having at least a conductive region near said plate, said plate and said circuit being electrically isolated from said conductive region where by, when said enclosure pivots to a predetermined position, about an horizontal axis, said contact making element resting in said cavity will move to make contact between said conductive region and said conductive circuit.

According to a second aspect of the present invention there is provided a motion and position sensor adapted to detect motion and lack of motion, comprising:

a motion and position sensing switch having means indicative of the motion of a contact making element in said switch and being adapted to provide at least a first and second electrical state corresponding to the motion and lack of motion of said contact making element;

means for detecting said first and second electrical state, said detecting means being adapted to provide a signal indicative of the electrical state of said switch.

According to a third aspect of the present invention there is provided a motion sensor adapted to detect motion and lack of motion, comprising:

an enclosure with an open end;

a base for covering said open end;

pressure sensitive electrical sensing means on said base, facing said enclosure and motion sensitive weight means in said enclosure adapted to move freely in said enclosure such that when said weight means move over said sensing means, an electrical signal indicative of the motion of said weight means over said sensing means can be detected.

DESCRIPTION OF THE DRAWINGS

Particular embodiments of the invention will be understood in conjunction with the accompanying drawings in which.

DESCRIPTION OF THE PREFERRED EMBODIMENTS

Figure 1:
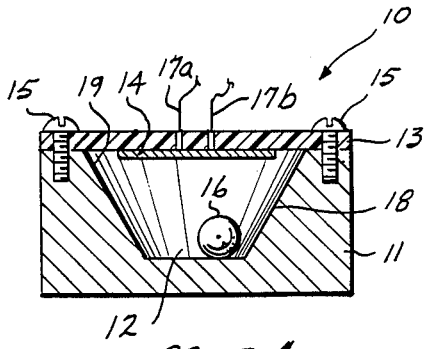
FIG. 1 is a sectional view of a sensing switch according to an embodiment of the present invention.

Referring now to FIG. 1, we have shown generally at reference numeral 10 a sectional view of the motion and position sensing switch of the present invention. When placed in a horizontal position, the switch is in the off state.

The motion and position sensing switch is comprised of an electrically conductive enclosure 11 having a truncated cone shaped cavity 12. It will be understood by those knowledgeable in this art that cavity 12 may have other shapes as well. Enclosure 11 and cavity 12 are capped by means of a plate 13 having a conductive circuit 14, electrically isolated from enclosure 11. Plate 13 is secured onto enclosure 11 by means of fasteners 15 which can consist of self-tapping screws and the like. A conductive ball 16 is used as a contact making element between conductive enclosure 11 and conductive circuit 14.

A pair of conductors 17*a* and 17*b* can be connected to a suitable detecting circuit (not shown) adapted to monitor the change of state of switch 10. The interior edge 18 of cavity 12 makes an angle of 30° from a vertical axis. When switch 10 pivots about the horizontal axis, to an angle greater than 60° from the vertical axis, conductive ball 16 rolls to the outer edge 19 of cavity 12, thereby allowing contact to be made between enclosure 11 and conductive circuit 14. (See FIG. 2). In this position, switch 10 now turns to an active state since current is allowed to flow from enclosure 11 to conductive circuit 14 and to a detecting circuit via conductor 17*a* and 17*b*.

Figure 2:
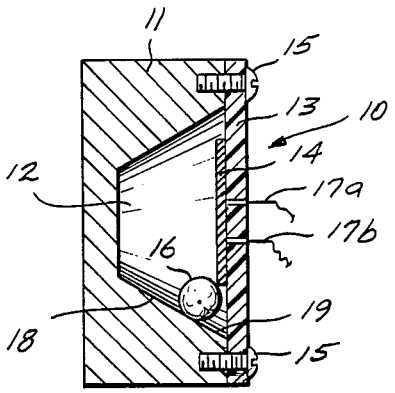
FIG. 2 is a sectional view of the sensing switch of FIG. 1 shown pivoted from a horizontal to a vertical position.
Figure 3:
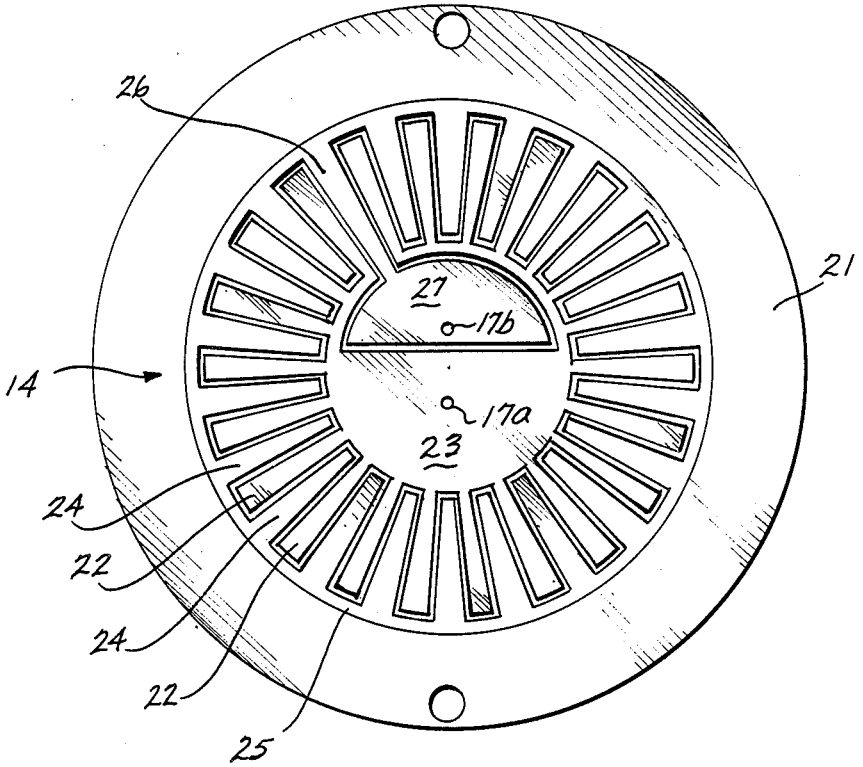
FIG. 3 is a top view of a conductive circuit used with a motion sensing switch of FIG. 1.

Referring now to FIG. 3, we have shown a top view of the conductive circuit shown at reference numeral 14 of FIGS. 1 and 2. Conductive circuit 14 is comprised of a gold plated circuit etched on a non-conductive surface 21. In the present embodiment, conductive circuit 14 forms two separate electrical conductive regions. These regions are comprised of a first set of conductive lines or fingers 22 extending outwardly from a central conductive region 23. Each finger is positioned radially in spaced relationship. A second set of lines or fingers 24 extend inwardly from a peripheral conductive ring 25 located outwardly from the first set of lines 22. The second set of lines 24 are positioned radially in spaced relationship adjacent to the first set of lines 22. A separate conductive line 26 is used to connect conductive ring 25 to a central conductive region 27 lying adjacent to conductive region 23. The first and second set of lines are electrically isolated from one another. Conductive regions 23 and 27 are individually connected to a detecting circuit (not shown) by means of conductors 17*a* and 17*b*, respectively.

Conductive circuit 14 allows switch 10 to provide, while in the active state, three possible electrical state changes. For example, conductive ball 16 can make electrical contact between enclosure 11 and conductive fingers 22, between enclosure 11 and conductive fingers 24 and between enclosure 11 and conductive fingers 22 and 24. That is, the conductive ball 16 can make contact with fingers 22, 24 or both.

Similarly, conductive circuit 14 could be designated with a single set of conductive fingers separated by non-conductive fingers thereby allowing a detecting circuit to detect a change of state of the motion sensing switch. It will be understood by those knowledgeable in this art that other circuit designs can be used to arrive at the same results without departing from the scope of the invention.

Figure 4:
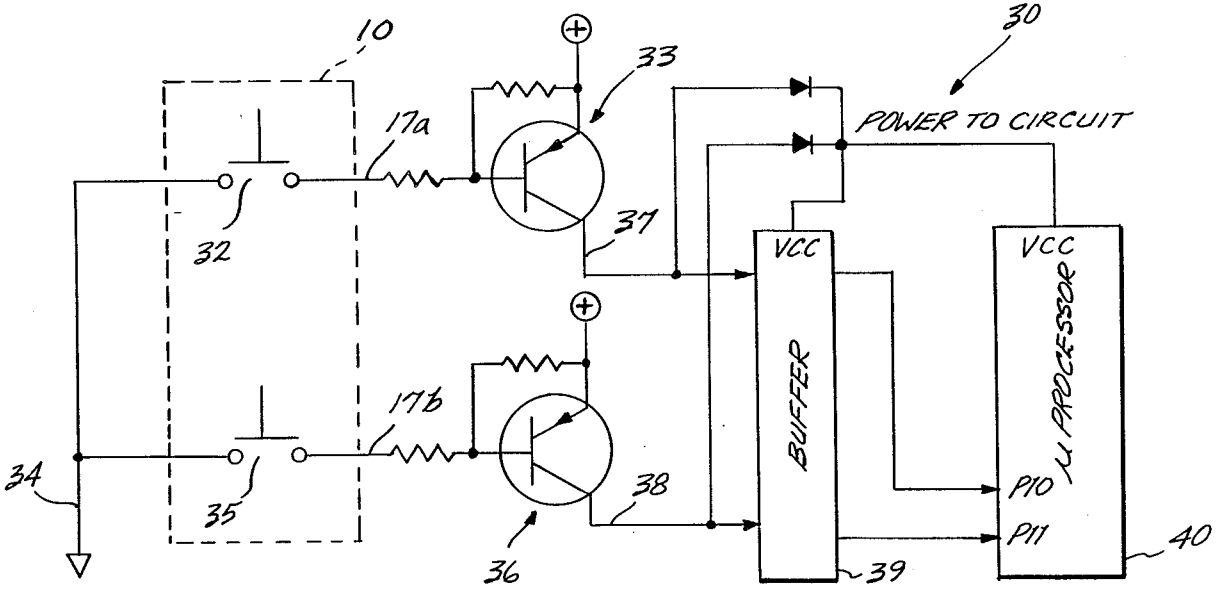
FIG. 4 is a block diagram of a motion sensor using the motion sensing switch of the present invention.

Referring now to FIG. 4, a block diagram of a motion sensor circuit is depicted at reference numeral 30. The motion sensing switch is depicted by circuit 10 defined by the dotted line. Switch 32 represents the opening and closing of electrical contact made by the conductive ball between enclosure 11 and fingers 22. Conductor 17*a* leads from switch 10 to a transistor switching circuit 33. Enclosure 11 is connected to ground by means of conductor 34 which is not shown in FIGS. 1 and 2 for the sake of clarity. Switch 35 represents the opening and closing of electrical contact made by conductive ball 16 between enclosure 11 and fingers 24. Conductor 17*b* connects conductive region 27 to transistor switching circuit 36.

The collectors 37 and 38 from the transistor switching circuits 33 and 36 are connected to a buffer circuit 39. The output of the buffer circuit is then connected to a microprocessor 40.

The microprocessor 40 senses the two switch inputs. Whenever the microprocessor detects a change of state created by switch 32 and 35, i.e. switch 32 open, switch 35 closed, switch 32 closed, switch 35 open or switch 32 and 35 closed, an internal timer (not shown) is reset and activated. However, if the timer reaches a preset value before a change of state is detected, then an alarm is initiated. This would occur, for example, if conductive ball 16 remained motionless making contact between enclosure 11 and conductive circuit 14.

In another embodiment, motion sensing switch 10 could be made of a non-conductive enclosure and provided with a conductive region near the outer edge of the cavity, such that when the contact making element moves to the outer edge of the cavity, contact is made between ground and the conductive circuit.

Figure 5:
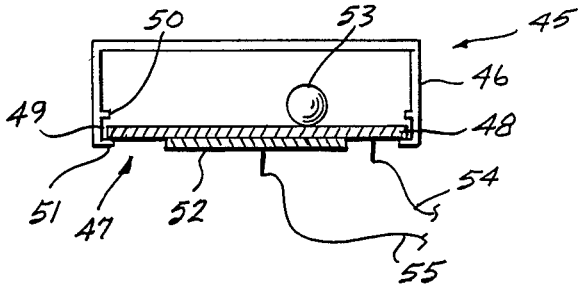
FIG. 5 is a sectional view of a second type of motion sensor according to the present invention.

Referring now to FIG. 5 we have shown at reference numeral 45 a sectional view of a motion sensor according to another embodiment of the present invention. The sensor is comprised of an enclosure 46 having an open end shown generally at reference numeral 47 which is covered by means of a base 48 and secured therein by means a channel 49 formed by a pair of ridges 50 and 51.

Base 48 is provided with a pressure sensitive electrical sensor 52 which can consist of a piezoelectric element. A motion sensitive weight, such as ball bearing 53 is retained within enclosure 46 and can freely move therein. Leads 54 and 55 are connected to a detection circuit adapted to monitor any electrical impulses generated in which is indicative of the motion of ball bearing 53 on base 48.

Such a sensor, because of its ruggedness and simplicity is well suited for applications in the logging industry.

Figure 6:
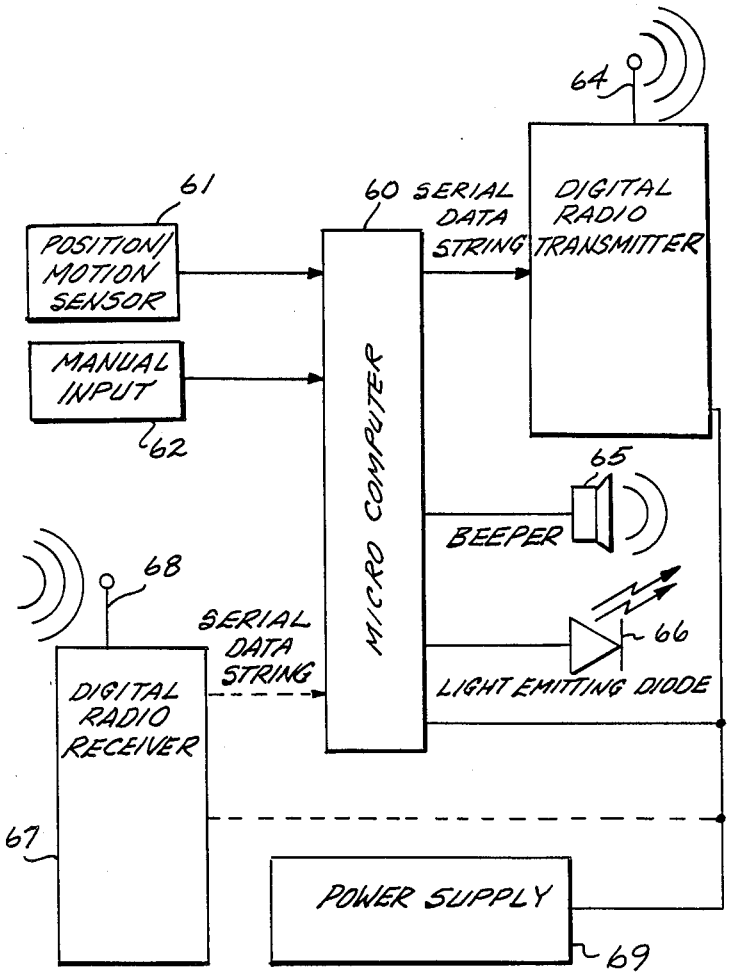
FIG. 6 is a block diagram of the personal security communication system of the present invention.

Referring now to FIG. 6, we have shown a block diagram of the personal security communication system of the present invention.

In this system, the microcomputer 60 is the heart of the system. It is responsible for monitoring the status of the user by means of the position/motion sensor 61 or manual input 62. Manual input 62 is basically comprised of a switch which is activatable by the user when an alarm condition exists. If, however, the user has become disabled, the position and motion sensor 61 can detect the existence of an alarm condition. If an alarm condition exists, microcomputer 60 will format a digital data message to be trasmitted through a radio transmitter 63 via antenna 64 to other units in the system or to a central station. When this condition exists, microcomputer 60 would activate signalling means such as beeper 65 and/or light emitting diode 66 forming part of each unit. An optional digital radio receiver 67 and receiving antenna 68 can be provided with each unit. The microcomputer 60 would listen to the signal provided by radio receiver 67 for messages coming from other units or from a base station. Computer 60 would then control the beeper 65 and light emitting diode 66 to display the status of the system.

The microcomputer 60 can consist of but is not limited to an Intel 80 51 microcontroller and external, single component EPROM memory chip. The radio transmittor 63 and receiver 67 are capable of transmitting and receiving a digital data message. The on/off keying and modulation of the transmitter 63 can be controlled by microcomputer 60. The receiver 67 will normally be on, and turned off during transmission. The power supply 69 is used to provide power to radio transmitter 63, receiver 67, microcomputer 60, beeper 65 and light emitting diode 66. The power supply can consist of a Nicad rechargeable battery pack. The system can be enclosed in a small housing and belt mounted.

The system can be configured with two units operating in a buddy system, wherein each unit monitors the other's status or in a group system, wherein the status of all the working units is monitored from a base station.

Figure 7:
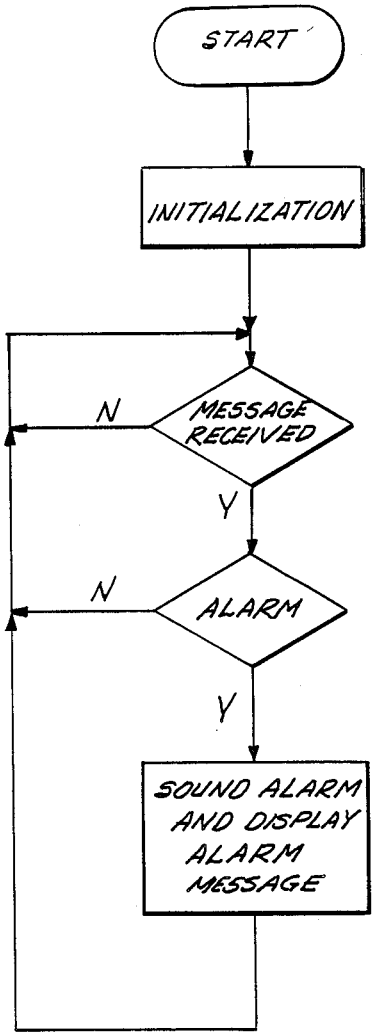
FIG. 7 is a flow chart for a non-polling base station.
Figure 8:
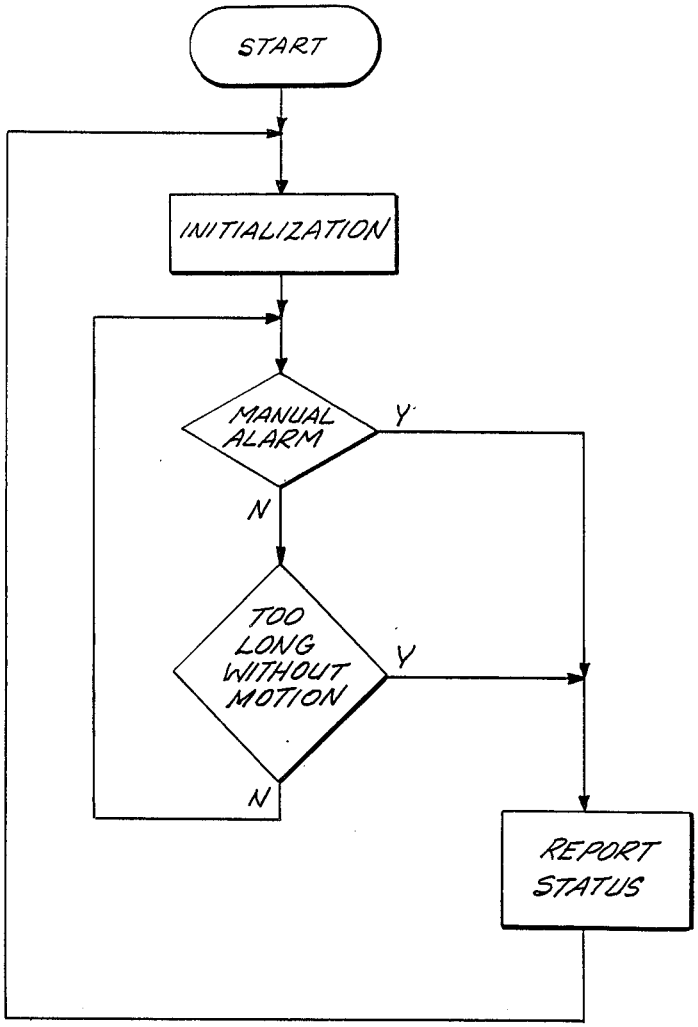
FIG. 8 is a flow chart for the portable units used in a non-polling network.

As indicated above, different modes of operation are possible using the present system. For example, in a non-polling network, each user would carry a unit having only the transmitter rather than both transmitter and receiver. The transmitter would be activated upon occurrence of an alarm condition. A signal would then be transmitted to a base station which would monitor all transmissions from each unit in the field. The information flow chart for both the base station and a unit is shown in FIGS. 7 and 8 respectively.

In the buddy system, each unit works in pairs and is provided with a receiver and a transmitter. In the buddy system, continuous status reports are transmitted between units such that a transmission that is submitted by a first unit is received and verified by the second unit in the pair.

Figure 9:
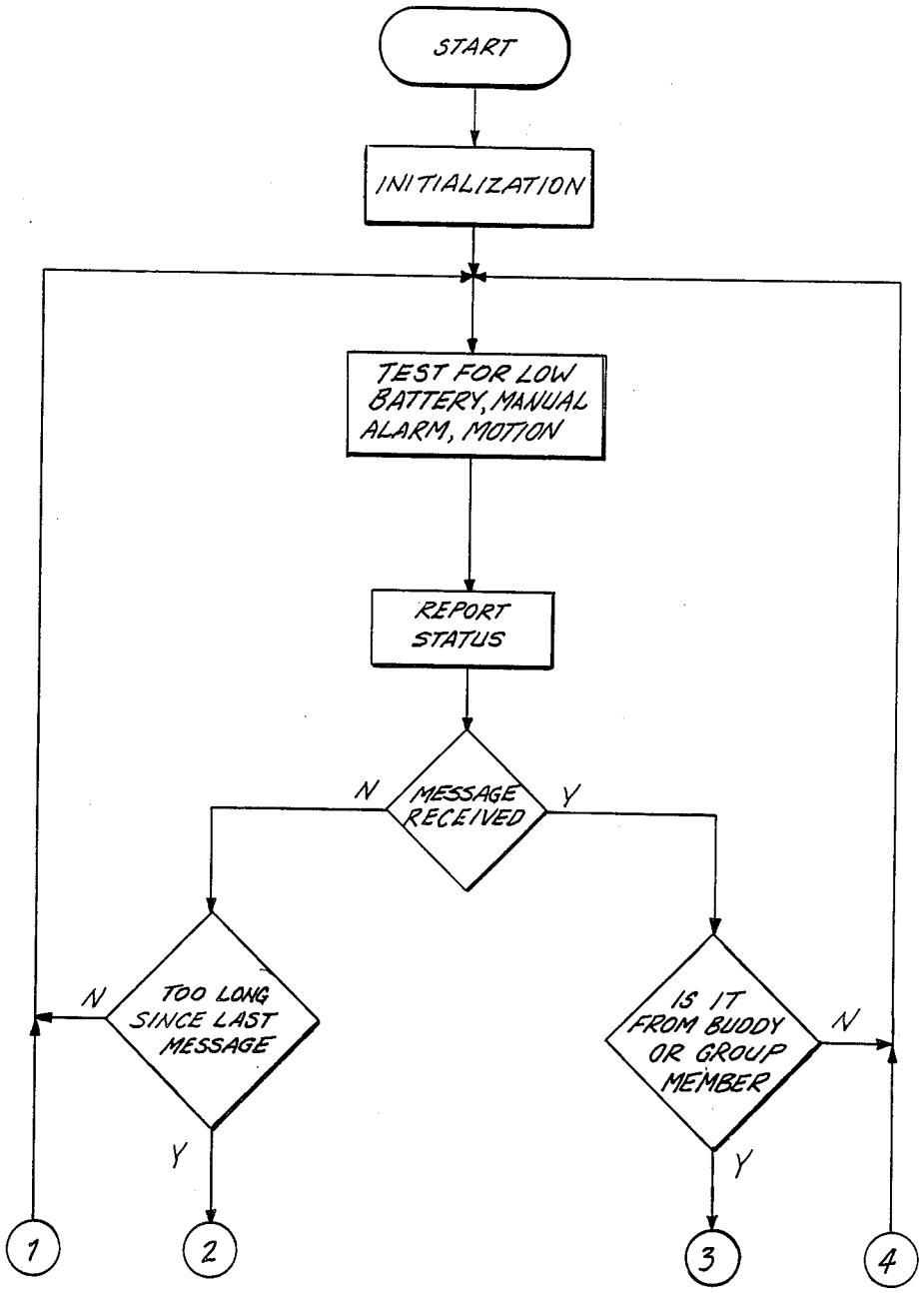
FIGS. 9 and 10 are flow charts for portable units in a buddy/group network.
Figure 10:
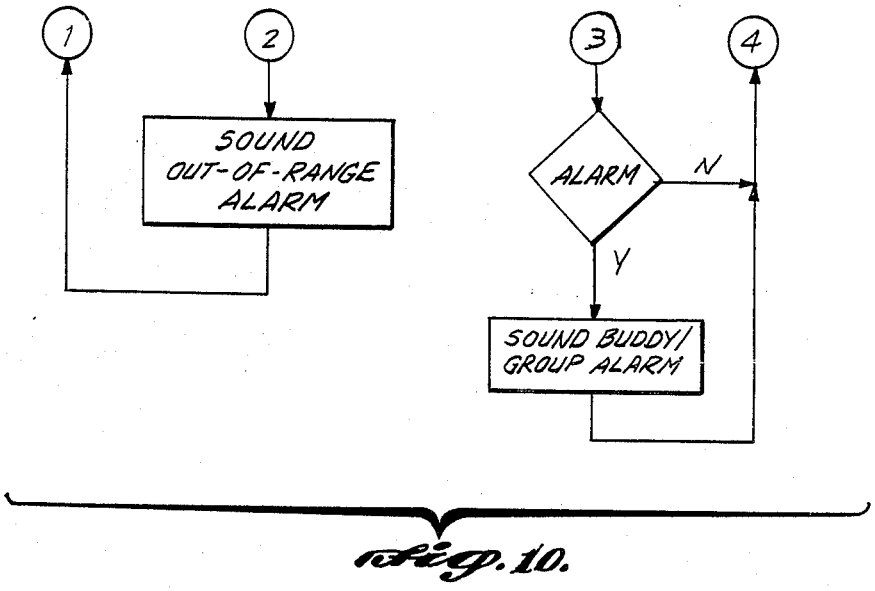

FIGS. 9 and 10 illustrate the information flow chart used for the buddy system.

Figure 12:
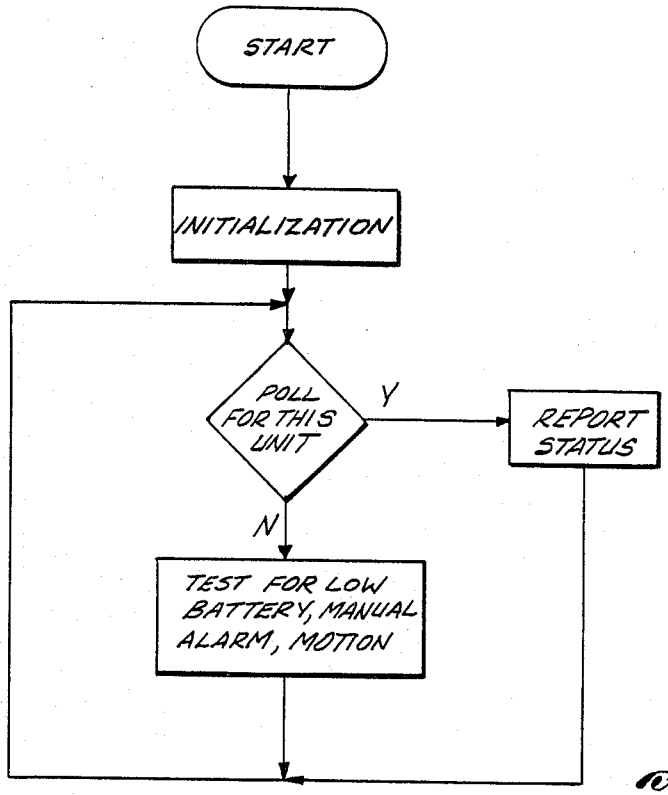
FIG. 12 is a flow chart for portable units used in a polling network.
Figure 11:
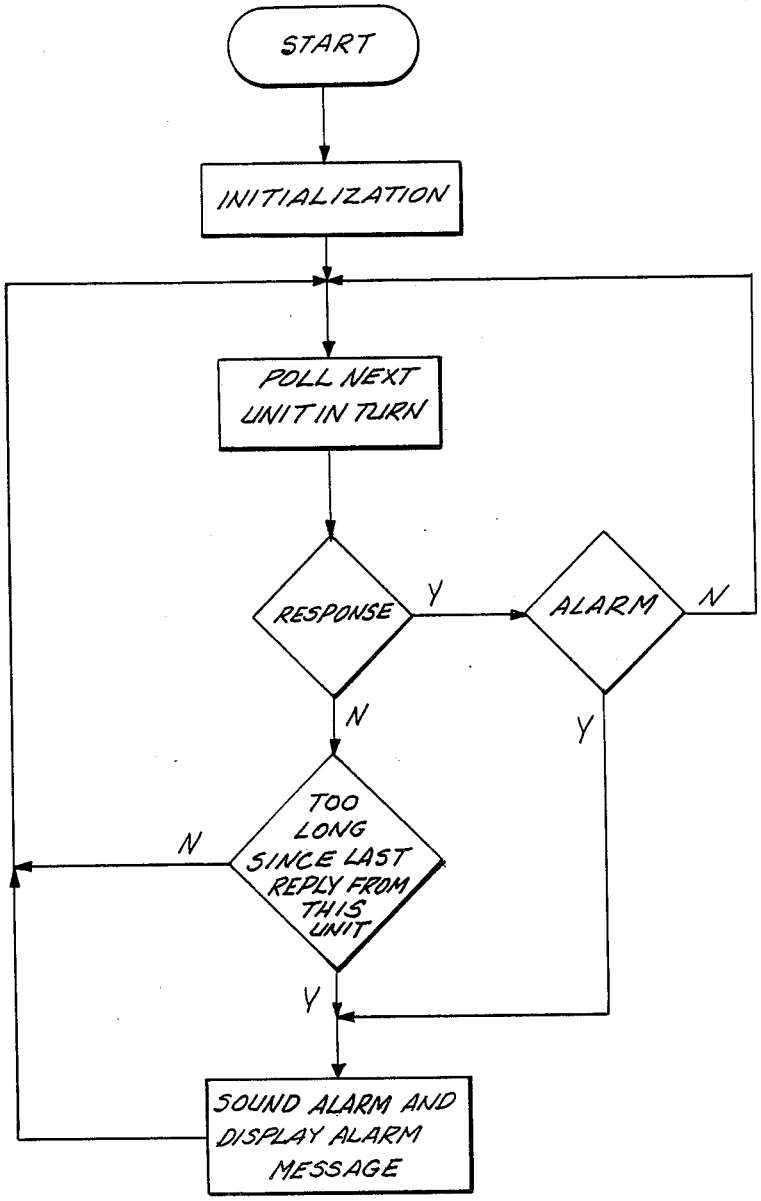
FIG. 11 is a flow chart for a polling base station.

In the preferred communication system, each unit worn by a worker in a group of workers is provided with a transmitter and a receiver. A base station will continuously poll the status of each individual. For example, the base station will poll a first unit and await a response prior to polling a second unit. If no response is received after a specified time, the alarm will be activated. The information flow chart for the base station is shown in FIG. 11. The information flow chart for the portable units is depicted in FIG. 12.

The embodiments of the invention in which an exclusive property or privilege is claimed are defined as follows:

1. A motion and position sensing switch comprising:
an enclosure having a cavity;
a contact-making element resting in said cavity;
a plate having a conductive circuit thereon that caps said cavity;
said cavity having a conductive region near said plate, said plate and said conductive circuit being electrically isolated from said conductive region, wherein, when said enclosure pivots to a predetermined position about a horizontal axis, said contact-making element resting in said cavity moves to make contact between said conductive region and said conductive circuit; and,
said conductive circuit comprising first and second conductive areas separated by a nonconductive region such that when said contact-making element makes contact between said first conductive area and said conductive region of said cavity, said switch is in a first state and when said contact-making element makes contact between said second conductive area and said conductive region of said cavity, said switch is in a second state.

2. A motion and position sensing switch comprising:
an enclosure having a cavity;
a contact-making element resting in said cavity;
a plate having a conductive circuit thereon that caps said cavity;
said cavity having a conductive region near said plate, said plate and said conductive circuit being electrically isolated from said conductive region, wherein, when said enclosure pivots to a predetermined position about a horizontal axis, said contact-making element resting in said cavity moves to make contact between said conductive region and said conductive circuit; and,
said conductive circuit comprising a first set of conductive lines extending outwardly from a center region and positioned radially in spaced relationship and a second set of conductive lines extending inwardly from a peripheral region located outwardly from said first set of conductive lines, said second set of conductive lines being positioned radially in spaced relationship adjacent said first set, said first and second set of conductive lines being electrically isolated from one another, such that when said contact-making element makes contact between a conductive line of said first set and said conductive region of said cavity, said switch is in a first state and when said contact-making element makes contact between a conductive line of said second and said conductive region, said switch is in a second state.

3. A motion and position sensing switch as defined in claim 2 wherein said enclosure is electrically conductive.

4. A motion and position sensing switch as defined in claim 3 wherein said cavity is cone-shaped.

5. A motion and position sensing switch as defined in claim 4 wherein said cavity has a truncated cone shape.

6. A motion and position sensing switch as defined in claim 5 wherein said cavity has an interior edge making an angle of 60° from an adjacent surface of said plate.

7. A motion and position sensing switch as defined in claim 6 wherein said contact-making element is comprised of a conductive ball.

8. A motion and position sensor for detecting motion and lack of motion, comprising:

a motion and position sensing switch that may be oriented in a first position and a second position and having motion detection means for detecting motion of a contact-making element in said switch when said switch is in said first position and not detecting motion of said contact-making element when said switch is in said second position, such that when said switch is in said second position, said motion detecting means places said switch in a first and second electrical state corresponding respectively to the motion and lack of motion of said contact-making element; and means for detecting said first and second electrical states of said switch, and providing signals indicative of the electrical state of said switch.

9. A motion and position sensor as defined in claim 8 wherein said motion and position sensing switch is comprised of an enclosure having a cavity, a contact-making element resting in said cavity, said cavity being capped with a plate having a conductive circuit thereon, said cavity having at least a conductive region near said plate, said plate and said conductive circuit being electrically isolated from said conductive region, whereby if said enclosure pivots to said second position about a horizontal axis, said contact-making element resting in said cavity will move to make contact between said conductive region and said conductive circuit.

10. A motion and position sensor as defined in claim 9 wherein said conductive circuit on said plate includes motion detecting means for detecting motion of said contact-making element on said conductive circuit.

11. A motion and position sensor as defined in claim 10 wherein said motion detecting means comprises conductive and non-conductive areas laid out on said circuit.

12. A motion and position sensor as defined in claim 11 wherein said cavity has an interior edge making an angle of 60° from an adjacent surface of said plate.

13. A motion and position sensor as defined in claim 12 wherein said contact-making element is comprised of a conductive ball.

14. A motion and position sensor as defined in claim 10 wherein said motion detecting means comprises first and second conductive areas separated by a non-conductive region such that when said contact-making element makes contact between said first conductive area and said conductive region of said cavity, said switch is in a first state and when said contact-making element makes contact between said conductive area and said conductive region of said cavity, said switch is in a second state.

15. A motion and position sensor as defined in claim 10 wherein said motion detecting means comprises a first set of conductive lines extending outwardly from a center region and positioned radially in spaced relationship and a second set of conductive lines extending inwardly from a peripheral region located outwardly from said first set of conductive lines, said second set of conductive lines being positioned radially in spaced relationship adjacent said first set, said first and second set of conductive lines being electrically isolated from one another, such that when said contact-making element makes contact between a conductive line of said first set and said conductive region, said switch is in a first state and when said contact-making element makes contact between a conductive line of said second and said conductive region, said switch is in a second state.

16. A motion and position sensor as defined in claim 15 wherein said enclosure is electrically conductive.

17. A motion and position sensor as defined in claim 16 wherein said cavity is cone-shaped.

18. A motion and position sensor as defined in claim 17 wherein said cavity has a truncated cone shape.

19. A motion and position sensor as defined in claim 18 wherein said cavity has an interior edge making an angle of 60° from an adjacent surface of said plate.

20. A motion and position sensor as defined in claim 19 wherein said contact-making element is comprised of a conductive ball.

21. A motion and position sensor as described in claim 9 further comprising timing means for monitoring the amount of time said switch remains in said first or second electrical state.

22. A motion and position sensor as defined in claim 21 wherein said motion sensing switch is comprised of an enclosure having a cavity, a contact-making element resting in said cavity, said cavity being capped with a plate having a conductive circuit thereon, said cavity having at least a conductive region near said plate, said plate and said conductive circuit being electrically isolated from said conductive region, whereby if said enclosure pivots to said second position about a horizontal axis, said contact-making element resting in said cavity will move to make contact between said conductive region and said conductive circuit.

23. A motion and position sensor as defined in claim 22 wherein said conductive circuit on said plate includes motion detecting means for detecting motion of said contact-making element on said conductive circuit.

24. A motion and position sensor as defined in claim 23 wherein said motion detecting means comprises conductive and non-conductive areas laid out on said conductive circuit.

25. A motion and position sensor as defined in claim 23 wherein said motion detecting means comprises first and second conductive areas separated by a non-conductive region such that when said contact-making element makes contact between said first conductive area and said conductive region of said cavity, said switch is in a first state and when said contact-making element makes contact between said second conductive area and said conductive region of said cavity, said switch is in a second state.

26. A motion and position sensor as defined in claim 23 wherein said motion detecting means comprises a first set of conductive lines extending outwardly from a center region and positioned radially in spaced relationship and a second set of conductive lines extending inwardly from a peripheral region located outwardly from said first set of conductive lines, said second set of conductive lines being positioned radially in spaced relationship adjacent said first set, said first and second set of conductive lines being electrically isolated from one another, such that when said contact-making element makes contact between a conductive line of said first set and said conductive region, said switch is in a first state and when said contact-making element makes contact between a conductive line of said second set and said conductive region, said switch is in a second state.

27. A motion and position sensor as defined in claim 26 wherein said enclosure is electrically conductive.

28. A motion and position sensor as defined in claim 27 wherein said cavity is cone-shaped.

29. A motion and position sensor as defined in claim 28 wherein said cavity has a truncated cone shape.

30. A motion and position sensor as defined in claim 29 wherein said cavity has an interior edge making an angle of 60° from an adjacent surface of said plate.

31. A motion and position sensor as defined in claim 30 wherein said contact-making element is comprised of a conductive ball.

32. A motion and position sensor as defined in claim 21 wherein said timing means is comprised of buffer and processor means adapted to monitor the amount of time said switch remains in said first or second state and adapted to control alarm means in response to the amount of time said switch remains in said first or second state.

33. A motion and position sensor as defined in claim 32 wherein said motion sensing switch is comprised of an enclosure having a cavity, a contact-making element resting in said cavity, said cavity being capped with a plate having a conductive circuit thereon, said cavity having at least a conductive region near said plate, said plate and said conductive circuit being electrically isolated from said conductive region, whereby if said enclosure pivots to said second position about a horizontal axis, said contact-making element resting in said cavity will move to make contact between said conductive region and said conductive circuit.

34. A motion and position sensor as defined in claim 33 wherein said conductive circuit on said plate includes motion detecting means for detecting motion of said contact-making element on said conductive circuit.

35. A motion and position sensor as defined in claim 34 wherein said motion detecting means comprises conductive and mon-conductive areas laid out on said circuit.

36. A motion and position sensor as defined in claim 34 wherein said motion detecting means comprises first and second conductive areas separated by a non-conductive region such that when said contact-making element makes contact between said first conductive area and said conductive region of said cavity, said switch is in a first state and when said contact-making element makes contact between said second conductive area and said conductive region of said cavity, said switch is in a second state.

37. A motion and position sensor as defined in claim 34 wherein said motion detecting means comprises a first set of conductive lines extending outwardly from a center region and positioned radially in spaced relationship and a second set of conductive lines extending inwardly from a peripheral region located outwardly from said first set of conductive lines, said second set of conductive lines being positioned radially in spaced relationship adjacent said first set, said first and second set of conductive lines being electrically isolated from one another, such that when said contact-making element makes contact between a conductive line of said first set and conductive region, said switch is in a first state and when said contact-making element makes contact between a conductive line of said second set and said conductive region, said switch is in a second state.

38. A motion and position sensor as defined in claim 37 wherein said enclosure is electrically conductive.

39. A motion and position sensor as defined in claim 38 wherein said cavity is cone-shaped.

40. A motion and position sensor as defined in claim 39 wherein said cavity has a truncated cone shape.

41. A motion sensor adapted to indicate motion and lack of motion, comprising:

an enclosure with an open end;

a base for covering said open end;

pressure sensitive electrical sensing means on said base, facing said enclosure and motion sensitive weight means in said enclosure adapted to move freely in said enclosure such that when said weight means move over said sensing means, an electrical signal indicative of the motion of said weight means over said sensing means can be detected.

42. A motion sensor as defined in claim 41 wherein said presure sensitive electrical sensing means comprises a piezoelectric element.

43. A motion sensor as defined in claim 42 wherein said weight means comprises a ball bearing.

* * * * *